United States Patent [19]

Crowley

[11] 4,273,045

[45] Jun. 16, 1981

[54] PRINTING MACHINE REGISTRATION TARGET

[75] Inventor: Bucky Crowley, Newton, Mass.

[73] Assignee: Butler Greenwich Inc., Greenwich, Conn.

[21] Appl. No.: 59,515

[22] Filed: Jul. 23, 1979

[51] Int. Cl.[3] ..... B41F 5/06

[52] U.S. Cl. ..... 101/211; 101/181

[58] Field of Search ..... 101/181, 248, DIG. 12, 101/401.1, 211, 216, 171, 178; 33/184.5, 174 R; 283/1 R; 226/2, 3, 28–31, 45

[56] References Cited

U.S. PATENT DOCUMENTS

| | | | |
|---|---|---|---|
| 1,151,461 | 8/1915 | Hatt | 33/184.5 |
| 3,015,266 | 1/1962 | Anderson et al. | 101/181 X |
| 3,701,464 | 10/1972 | Crum | 101/181 |
| 4,033,259 | 7/1977 | Schuhmann | 33/184.5 |

FOREIGN PATENT DOCUMENTS

| | | | |
|---|---|---|---|
| 1075199 | 2/1960 | Fed. Rep. of Germany | 101/181 |
| 1220485 | 1/1971 | United Kingdom | 101/181 |

*Primary Examiner*—J. Reed Fisher

*Attorney, Agent, or Firm*—Cesari and McKenna

[57] ABSTRACT

A registration target for printing on a web or sheet includes a pair of juxtaposed orthogonal arms, at least one of which extends lengthwise along the web. One or more tabs projects perpendicularly from each arm but only at one edge thereof. The widths of the arms and tabs substantially correspond to the stroke width of the lines and characters being printed on the web and the length of each tab is a multiple of that stroke width. By observing the orientations of the tabs and the amounts by which they project beyond one another of the targets printed by a series of print cylinders in a press, one can immediately discern the directions and amounts in terms of stroke width of any registration errors.

2 Claims, 3 Drawing Figures

PRINTING MACHINE REGISTRATION TARGET

BACKGROUND OF THE INVENTION

This invention relates to improved means for indicating registration of printed matter on a web or in a multicolor printing press or when the web makes multiple passes through a single cylinder press. It relates more particularly to an improved register target for printing on the web selvage of a web passing through a multicolor printing press in order to verify that the various press cylinders are in alignment during a press run.

Conventionally, a target such as a line or cross is printed by each print cylinder on the web selvage. If all of the cylinders are in register, the different colored crosses or lines printed by the cylinders are all superimposed. However, if a particular cylinder is out of register with the first or reference cylinder, the colored cross or line printed by that cylinder is offset from the others and will readily be visible. When that condition is observed by the operator, he can then retard or advance that cylinder or shift it axially to effect registration.

The prior register targets are disadvantaged, however, in that one cannot tell by observing them the amount by which a particular print cylinder is out of register. Therefore, several attempts may be required to correctly shift the cylinder to correct the registration error. Also if the web segment being examined is severed from the remainder of the web or otherwise loses its known orientation, the observation of the registration targets on that segment may not necessarily tell the operator the direction of the registration error. That is, the design being printed on a web may be nondirectional, e.g. polka dots and if, as happens, the usual targets are printed on both web selvages, one cannot tell from observing a segment of that web which edge was the right hand edge going through the press. Therefore one cannot determine from observing the out-of-register targets on that segment in which directions to make the corrections to restore registration. Therefore, the aligning of print cylinders by superpositioning different colored known registration targets on a web selvage may take a relatively long time, thereby causing excessive wastage of web.

SUMMARY OF THE INVENTION

Accordingly, it is an object of the present invention to provide an improved registration target for printing on a web being processed through a multi-color printing press.

Another object of the invention is to provide a registration target which apprises the operator of the amount of the registration error.

A further object of the invention is to provide such a target which also apprises the operator of the direction of the registration error in the event the web becomes disoriented.

Still another object is to provide a registration target which enables the operator to correct a registration error in a minimum amount of time, thereby minimizing the wastage of web.

Other objects will, in part, be obvious and will, in part, appear hereinafter.

The invention accordingly comprises the features of construction, combination of elements and arrangement of parts as will be exemplified in the following detailed description, and the scope of the invention will be indicated in the claims.

In accordance with this invention, the print cylinders in the press are arranged to print identical register marks or targets in different colors on the selvage of a web traveling through the press. The web may be paper, cloth, film, plastic tape, metal foil, silkscreen or the like. When all of the press cylinders are properly positioned, all of the different colored targets are superimposed. However, when one or another of the cylinders is not registered, the target printed by that cylinder is offset in one direction or the other from the other targets and is quite visible to the operator.

However, the present target does more than indicate an out-of-register condition. It also apprises the operator of the amount of the registration error and the direction of that error, i.e. whether it is in the advance, retard, left or right direction relative to the web advance direction. More particularly, my target comprises a cross composed of arms disposed at right angles. Preferably one arm is aligned with the direction of web advance and the other arm is transverse to the web advance direction. Also one or more tabs project laterally from each arm but only at one side thereof. For example, the arm aligned with the web advance direction may have tabs pointing toward the right, while the transversely oriented arm may have tabs pointed rearwardly or upstream of the web advance direction.

In accordance with this invention, the width of each target arm and tab coincides with the stroke width of the lines and characters printed by the various print cylinders. Furthermore, the length of the tabs and their positions on the arms correspond to integral multiples of the stroke width. Thus, by observing the relative positions of the tabs of the various different colored targets relative to those of the reference target, one can easily see the amounts of the registration errors in terms of multiples of the stroke width. Furthermore, even if a web segment should become separated from the remainder of the web and be disoriented so that one cannot tell from the segment itself which end was the leading end in the press, the orientations of the target tabs will provide this information. In other words, due to the asymmetrical positions of the tabs on the target arms, one can properly reorient the segment by arranging it, for example, so that the target arms extending lengthwise along the segment have their tabs pointing toward the right while the transverse target arms have their tabs projecting rearwardly. With the segment thus oriented as it was in the press, one can tell from observing the different colored target tabs the directions of the registration errors.

The present registration target is particularly suitable for use when the various press cylinders are positioned by a digital controller. One can arrange the controller so that each depression of a controller button shifts a particular print cylinder laterally or advances it or retards it circumferentially one stroke width. Therefore, when the operator observing the targets detects a registration error of one stroke width toward the left, he simply depresses the left error correction button controlling the offending cylinder once which automatically shifts that cylinder one stroke width toward the right. Likewise, when the target printed on the web by a certain cylinder is ahead of the reference target by two stroke widths, indicating that that particular cylinder is lagging behind the reference cylinder by two stroke widths, the operator can depress the appropriate controller button twice causing a two-stroke width advancement of the corresponding cylinder. In an arrangement such as this, then, an operator can bring all print cylinders in the press into proper registration in a minimum amount of time so that there is a minimum amount of web wastage.

BRIEF DESCRIPTION OF THE DRAWING

For a fuller understanding of the nature and objects of the invention, reference should be had to the following detailed description taken in connection with the accompanying drawing in which.

DESCRIPTION OF THE PREFERRED EMBODIMENT

Figure 1:
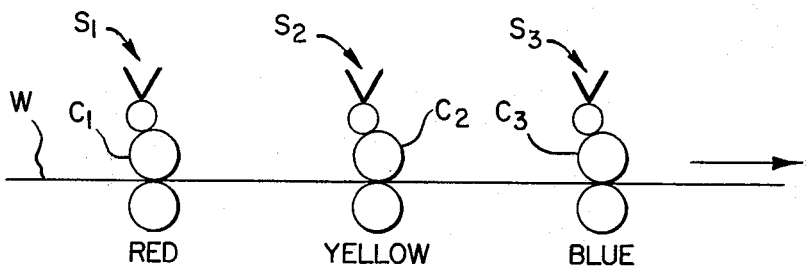
FIG. 1 is a diagrammatic view of a three-color printing press.

Referring to FIG. 1 of the drawing although the invention has utility when printing on any kind of web in any type of press, in this example, a web W is shown traveling through a printing press containing three printing stations S1, S2 and S3. The stations include print cylinders C1, C2 and C3 which print lines or characters having a stroke width P (FIG. 3) in three different colors on web W. For example, the cylinders C1 to C3 may print the colors red, yellow and blue. For registration purposes, we will assume that the first cylinder printing red is the reference cylinder.

Figure 2:
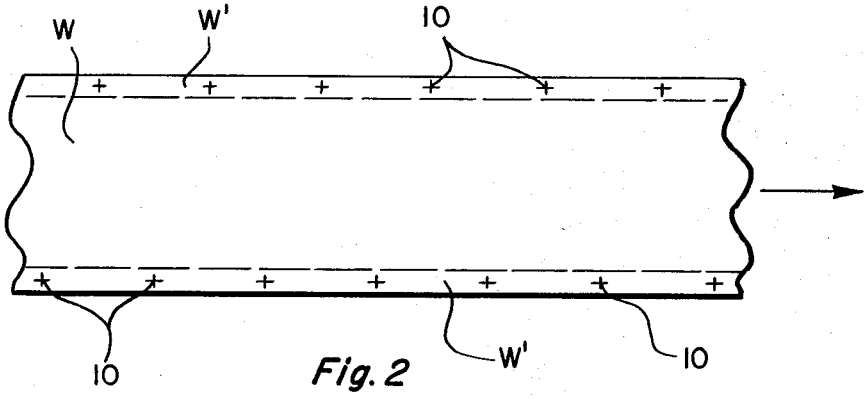
FIG. 2 is a fragmentary perspective view showing a web segment printed with registration targets made in accordance with this invention.

Turning now to FIG. 2, in addition to printing the pattern on the web, each cylinder prints indicium in the form of a registration target 10 once each revolution of the cylinder on the web. Although the indicium could be printed anywhere on the web, preferably it is placed on one or both selvages W′ of the web. When all of the cylinders are in register, these three different colored targets 10, superimposed as shown in that figure, are printed along one or both web selvages.

Figure 3:
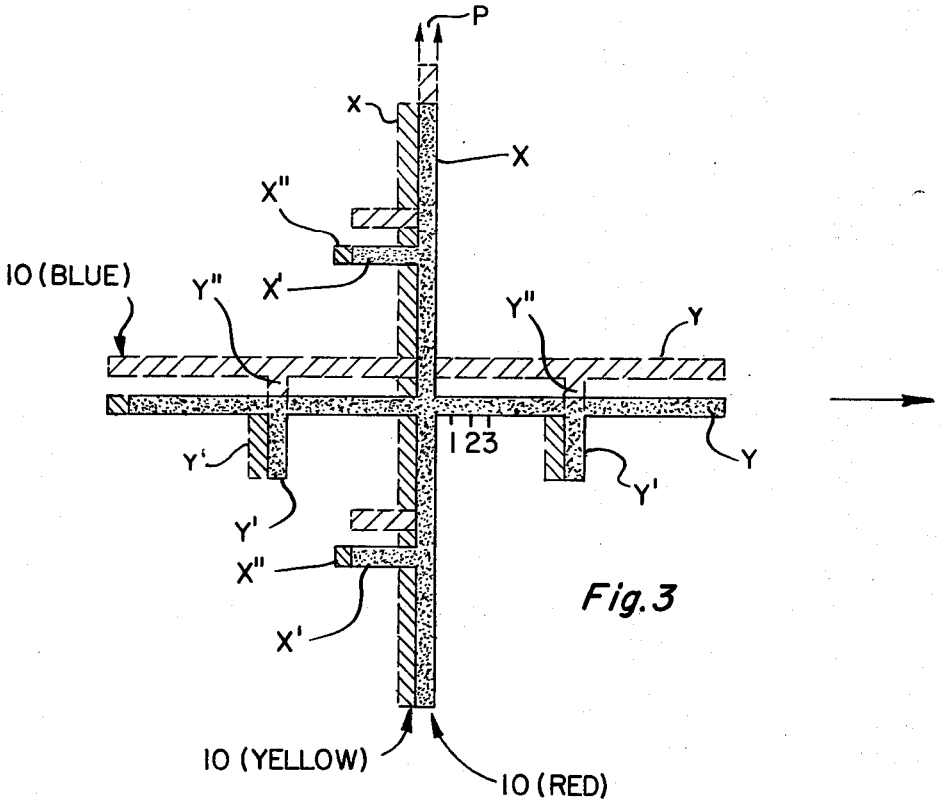
FIG. 3 is a top plan view showing a target on the FIG. 2 web in greater detail.

Referring now to FIG. 3, each target 10 is in the form of a cross having one arm Y extending along the web selvage W′ in the direction of web advance and a second arm X extending perpendicular to arm Y or transversely across the web selvage. Furthermore, each arm is formed with one or more tabs which extends out perpendicular to that arm but only at one side thereof. Thus arm X includes a pair of tabs X′ which extend rearwardly or in the direction opposite the direction of web advance, while arm Y has a pair of tabs Y′ which extend toward the right as viewed in FIG. 3. Thus by observing the orientation of the target 10, one can immediately tell which edge of the web was the right-hand edge when the web was proceeding through the printing press. This feature greatly facilitates registering the printing cylinders as will be described later.

It is a feature of this invention that the widths of the arms and tabs equals the stroke width P of the lines and characters being printed by the various printing cylinders C1 to C3, e.g., 0.005 inch for example. Also the length of each arm and of each tab X′ and Y′ and the spacing of each tab along its arm is an integral multiple of that stroke width P. For example, each tab might be 0.015 inch long or three times the stroke width, each arm could be 0.120 inch long or twenty times that width and each tab might be positioned midway between the center of its arm and the end thereof, i.e. 0.030 inch or six stroke widths.

When all three print cylinders C1 to C3 are in register, the red, yellow and blue targets 10 will be superimposed so that a single, essentially black target appears at each target location along the web selvage W′ as shown in FIG. 2. However, when a print cylinder is out of register with the first or reference cylinder C1, the uniquely colored target printed by that offending cylinder will be displaced relative to the red target printed by the reference cylinder. The direction of that displacement relative to the reference target indicates the direction of the registration error, while the relative positions between the arms and tabs on the errant target relative to those components of the reference target indicates the extent of the error in terms of multiples of the stroke width.

For example and referring to FIG. 3, if cylinder C2 which prints yellow leads the reference cylinder C1, the yellow target printed by that cylinder is shifted rearwardly relative to the red target printed by the reference cylinder as clearly shown in FIG. 3. It is easily seen from the amount by which the ends X″ of the yellow tabs extend rearwardly of the red tabs X′ that the amount of the error in this example is substantially one stroke width or 0.005 inch. In other words, the rearwardly projecting portion X″ of each yellow tab is obviously a square so that the error is obviously the same as the stroke width. Observing the red and yellow tabs Y′ as being identical rectangles achieves the same result. Therefore, correction is made by retarding the yellow print cylinder one stroke width.

In the same fashion, one can easily see from FIG. 3 that the blue print cylinder C3 is out of register to the left relative to the reference cylinder since the blue target is displaced to the left relative to the red target. By observing the segments Y″ of the blue tabs Y′ exposed to the left of the red arm Y as being squares, one knows immediately that the blue printer is out of register to the left by two stroke widths or 0.010 inch. Therefore, one can shift the blue print cylinder C3 to the right two stroke widths to correct the error. If one observes these segments Y″ as being twice as long as they are wide, then one immediately knows that there is a three stroke error in that same direction and can correct accordingly. Registration errors of appreciably less than one stroke width are usually too small for the eye to resolve and may be ignored.

Even the amounts of gross errors can be determined by observing the relative positions of the arms or tabs of an errant target and those of the reference target. For example, if arm Y of the blue target in FIG. 3 is superimposed on the left tab X′ of the red target which is six stroke widths away from the center of that target, the error is obviously six stroke widths to the left or 0.030 inch. In the same manner, the amounts of any registration errors to the right or in the forward direction can be determined quite accurately. Also, numbers can be included adjacent the arms and tabs of the target indicating errors by stroke width numbers as indicated at 1, 2, 3 on arm Y in FIG. 3 to facilitate register correction.

It is important to note that, even if the web segment W illustrated in FIG. 2 becomes disoriented, the targets 10 on that segment can still be used to register the print cylinders. This is because the directions of the tabs X′ and Y′ on target 10 will always indicate which edge of the web segment was the right-hand edge when that segment was passing through the printing press. Therefore, there is no likelihood of registration corrections being made in the opposite or wrong directions on the basis of the targets printed on selvages W.

The present registration target has particular utility when used in conjunction with a digital controller for positioning the printing cylinders. The cylinder positioners can be incremented in multiples of the stroke width so that if one sees from the registration targets that the blue target is ahead of the reference red target by one stroke width, the operator can actuate the digital controller once to advance the blue cylinder by one stroke width which will bring the two targets into superposition. Likewise, when the operator observes the blue target displaced from the red target to the left three stroke widths, he can actuate the digital positioner for that cylinder thrice to shift the cylinder to the right three stroke widths. In this way, all of the cylinders in the press may be registered in a minimum amount of time. Consequently, there is a minimum amount of web wastage due to out-of-register patterns printed on the web.

It will thus be seen that the objects set forth above, among those made apparent from the preceding description, are efficiently attained. Also, certain changes may be made in the above construction without departing from the scope of the invention. For example, tabs could extend out from both sides of each arm, the tabs on one side being longer than those on the other side to provide the aforementioned direction-indicating asymmetry. Therefore, it is intended that all matter contained in the above description or shown in the accompanying drawing be interpreted as illustrative and not in a limiting sense.

It is also to be understood that the following claims are intended to cover all of the generic and specific features of the invention herein described.

I claim:

1. In a method of indicating registration of printing on a web in a rotary multicolor printing press wherein a plurality of colors are printed successively on a web by a plurality of cylinders, the steps comprising printing on a selvage of the web in said plurality of colors with said plurality of cylinders indicium for registration with one another, each indicium having a pair of arms which intersect intermediate their ends at right angles so as to form a cross, one of said arms extending in a direction parallel to the direction of web travel through the press, the other of said arms extending transversely thereto, at least one tab extending out from each arm in one direction parallel to the other arm, said tab having no counterpart extending out from each arm in the opposite direction so that each said indicium is rectilinear yet asymmetric about the long axes of said arms, the widths of the arms and tabs of each indicium being substantially equal to the stroke width of the lines printed by each print cylinder on the web between its selvages, the lengths of each indicium arm and tab being integral multiples of said stroke width, and the distance between each indicium tab and the intersection of said indicium arms being an integral multiple of said stroke width thereby to indicate registration within the allowable tolerance when the corresponding arms and tabs of all of the indicia overlap one another to some extent and beyond the allowable tolerance when the corresponding arms and tabs of at least two of the indicia do not overlap, the direction of the unacceptable registration error being readily apparent from the orientation of the tabs and the amount of said error being evident by the number of stroke width segments visable between the corresponding arms and tabs of the out-of-registration indicia.

2. An apparatus for indicating registration of printing on a web in a rotary multicolor printing press wherein a plurality of colors are printed successively on a web by a plurality of cylinders, the combination of printing means on said cylinders for printing on a selvage of the web in said plurality of colors, indicia for registration with one another, each indicium having a pair of arms which intersect intermediate their ends at right angles so as to form a cross, one of said arms extending in a direction parallel to the direction of web travel through the press, the other of said arms extending transversely thereto, each indicium also having at least one tab extending out from each arm in one direction parallel to the other arm, said tab having no counterpart extending out from each arm in the opposite direction so that each said indicium is rectilinear yet asymmetric about the long axis of said arms, the widths of said arms and tabs of each indicium being substantially equal to the stroke width of the lines printed by each print cylinder on the web between its selvages, the lengths of each indicium arm and tab being integral multiples of said stroke width, and the distance between each indicium tab and the intersection of said indicium arms being an integral multiple of said stroke width, thereby to indicate registration within the allowable tolerance when the corresponding arms and tabs of all of the indicia overlap one another to some extent, and beyond the allowable tolerance when the corresponding arms and tabs of at least two of said indicia do not overlap, the direction of unacceptable registration error being readily apparent from the orientation of the tabs and the amount of said error being evident by the number of stroke width segments visible between the corresponding arms and tabs of the out-of-register indicia.

* * * * *